US008393744B2

(12) United States Patent
Lierow

(10) Patent No.: US 8,393,744 B2
(45) Date of Patent: Mar. 12, 2013

(54) ESCAPE ROUTE MARKING FOR AN AIRPLANE

(75) Inventor: Hans-Christian Lierow, Hamburg (DE)

(73) Assignee: Lufthansa Technik AG, Hamburg (DE)

( * ) Notice: Subject to any disclaimer, the term of this patent is extended or adjusted under 35 U.S.C. 154(b) by 542 days.

(21) Appl. No.: 12/598,739

(22) PCT Filed: Apr. 18, 2008

(86) PCT No.: PCT/EP2008/003114

§ 371 (c)(1),
(2), (4) Date: Mar. 8, 2010

(87) PCT Pub. No.: WO2008/135145

PCT Pub. Date: Nov. 13, 2008

(65) Prior Publication Data

US 2010/0165648 A1 Jul. 1, 2010

(30) Foreign Application Priority Data

May 4, 2007 (EP) ..... 07008989

(51) Int. Cl.
*F21V 9/16* (2006.01)

(52) U.S. Cl. ..... 362/84; 362/217.08

(58) Field of Classification Search ..... 362/34, 362/217.08, 260, 470, 103–108, 84
See application file for complete search history.

(56) References Cited

U.S. PATENT DOCUMENTS

| | | | | |
|---|---|---|---|---|
| 1,058,942 | A | 11/1977 | Naka | |
| 4,058,942 | A | 11/1977 | Naka | |
| 4,401,050 | A | 8/1983 | Britt et al. | |
| 5,904,017 | A * | 5/1999 | Glatz et al. | 52/287.1 |
| 6,359,381 | B1 * | 3/2002 | Okuno et al. | 313/485 |
| 6,525,111 | B1 * | 2/2003 | Spencer et al. | 523/218 |
| 6,874,919 | B2 | 4/2005 | Stokes et al. | |
| 2002/0015309 | A1 | 2/2002 | Stokes et al. | |
| 2004/0266554 | A1 | 12/2004 | Park et al. | |
| 2006/0162620 | A1 | 7/2006 | Horton et al. | |

FOREIGN PATENT DOCUMENTS

| | | | |
|---|---|---|---|
| EP | 0489561 | A1 | 11/2009 |
| FR | 2308155 | | 4/1975 |
| JP | 03-95270 | | 4/1991 |
| JP | 317692 | A | 12/1993 |
| JP | 10-3276 | | 1/1998 |
| JP | 10-46529 | | 2/1998 |
| JP | 10-212427 | | 8/1998 |
| JP | 11-513281 | | 11/1999 |
| JP | 200211835 | | 1/2002 |
| JP | 2003-305936 | | 10/2003 |
| WO | 87/02813 | | 5/1987 |
| WO | 94/17766 | | 8/1994 |
| WO | 96/33093 | | 10/1996 |
| WO | 2007/042438 | A1 | 4/2007 |

* cited by examiner

*Primary Examiner* — Anne Hines
(74) *Attorney, Agent, or Firm* — Vidas, Arrett & Steinkraus, P.A.

(57) ABSTRACT

An escape route marking for a passenger cabin in an airplane, with a plurality of longitudinal segments which are sequentially arranged along the escape route that is to be marked, wherein each segment has a support module and a light module that is arranged on the support module, and the light module has an essentially transparent plastic material into which photo-luminescent pigments are mixed which afterglow in the dark, wherein the pigments are micro-encapsulated in a second material such that liquid and moisture do not come into contact with the pigments.

13 Claims, 2 Drawing Sheets

ESCAPE ROUTE MARKING FOR AN AIRPLANE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

In aeroplanes it is known to arrange photo-luminescent stripes on the floor of the passenger cabin of the aeroplane in order to mark the escape route, which is also designated as an emergency marking. Photo-luminescence is here and then also called afterglow and/or phosphorescence. The requirements for the escape route marking under the aspect of safety are specified in the German industry norm DIN 67 510, for instance. The stripes are installed rectilinearly in the flooring, and in the emergency case, they indicate the way to the exits and the escape hatches to the passengers and the crew. In the past, photo-luminescent stripes have increasingly become accepted in the construction of aeroplanes, because they can be operated without voltage supply and do afterglow for a sufficient period of time and with sufficient brightness in the dark with the pigments that are presently at hand.

For instance from WO 96/33093 A1, an emergency lighting is known, in which a photo-luminescent stripe is incorporated into a transparent plastic material. Xylene, 2-butoxyethanol and cyclohexanone are used as the dyes for the photo-luminescent material.

A photo-luminescent reflection layer is known from WO 94/17766 A1, wherein phosphorescent pigments are applied in patterns to a substrate by screen printing.

A photo-luminescent escape route marking is known from U.S. Pat. No. 4,401,050, wherein the photo-luminescent material is applied to the backside of a layer of a flat material that is made of plastic material.

Direction pointers for the escape route are known from WO 87/02813 A1, wherein photo-luminescent means are applied to a substrate material by spraying or screen printing.

A permanently fluorescing layer is known from EP 0 489 561 A1, wherein colour pigments are incorporated into a polymer matrix. In this, the fluorescent material can be incorporated into a carrier, which impairs different optical properties to the fluorescence light by additional filters.

Safety signs backed by a photo-luminescent material are known from FR 2 308 155 A1, wherein a dispersion with photo-luminescent pigments is applied to a transparent layer of plastic material.

In the use of known escape route markings, the problem has arisen again and again that areas of the marking loose their lighting power and/or their colour after the installation of the escape route marking.

BRIEF SUMMARY OF THE INVENTION

The present invention is based on the objective to provide an escape route marking which can be permanently installed in the passenger cabin of an aeroplane by simple means.

According to the present invention, this objective is achieved by an escape route marking with the features of claim 1. Advantageous embodiments form the subject matter of the subclaims.

The escape route marking of the present invention is suitable for the passenger cabin of an aeroplane. The escape route marking has a plurality of longitudinal segments which are sequentially arranged on the flooring along the escape route that is to be marked. The longitudinal segments may have an arbitrary shape, in particular also a rectilinear or a curved course. Each segment features a support module and a light module. The light module is arranged on the support module. The light module consists of an essentially transparent plastic material into which photo-luminescent pigments are incorporated which generate the desired afterglow in the dark.

According to the present invention, the pigments are micro-encapsulated in a second material, such that liquid and moisture cannot come into contact with the pigments. The pigments are completely encapsulated in the second material. The invention is based on the finding that lacking lighting power or the turning dark of the light modules, which can express itself for instance also in brown or black spots, are due to liquid and/or liquid vapour, which initiate a chemical reaction of the pigments in the course of time, in the progression of which a brown colouring will take place, the so-called pigment corrosion. By a microscopic encapsulation of the pigments it is made sure that the pigments do not corrode even in the lapse of time, and thus they do not loose lighting power. A particular advantage of the escape route marking of the present invention is that the light module can be cut without that the cut edge can corrode.

In the second material it is preferably dealt with a plastic material. The plastic material for the encapsulation is preferably different from that plastic material into which the encapsulated pigments are incorporated.

Silicate or glass can be also used for the second material.

The transparent plastic material of the light module has a thickness of 0.1 mm to 2.0 mm, preferably the transparent plastic material is made with a thickness of 0.2 to 1.5 mm. The transparent plastic material forms a matrix in which the micro-encapsulated pigments are maintained in a preferably uniform distribution.

In a preferred method of production, the transparent plastic material is extruded together with the pigments. Alternatively, it is also possible to print the transparent plastic material with the pigments onto the support module; screen printing being used preferably in this. In an alternative embodiment, it is also possible to cast the transparent plastic material so as to form a light module, the micro-encapsulated pigments being also cast together in doing so.

It is also possible to spray the transparent plastic material onto the support material together with the pigments, and to let it congeal thereon.

In a preferred embodiment, photo-luminescent pigments are used that contain strontium aluminate. These pigments may be processed in solvent-containing lacquers, printing inks, thermo- and printing paste and in plastisoles. Polypropylene and polyethylene are particularly suited for the encapsulation of the pigments. The material may be polymerised further, in particular for achieving the desired micro-encapsulation. For instance, a polypropylene grafted with maleic acid anhydride can be used for the encapsulation. Other plastic materials which provide sufficient micro-encapsulation of the pigments are also possible.

In the completed light module, the encapsulated pigments are incorporated into the polymer matrix of the first plastic material.

BRIEF DESCRIPTION OF THE SEVERAL VIEWS OF THE DRAWINGS

Two examples of the escape route marking of the present invention are explained in more detail in the following.

DETAILED DESCRIPTION OF THE INVENTION

Figure 1:
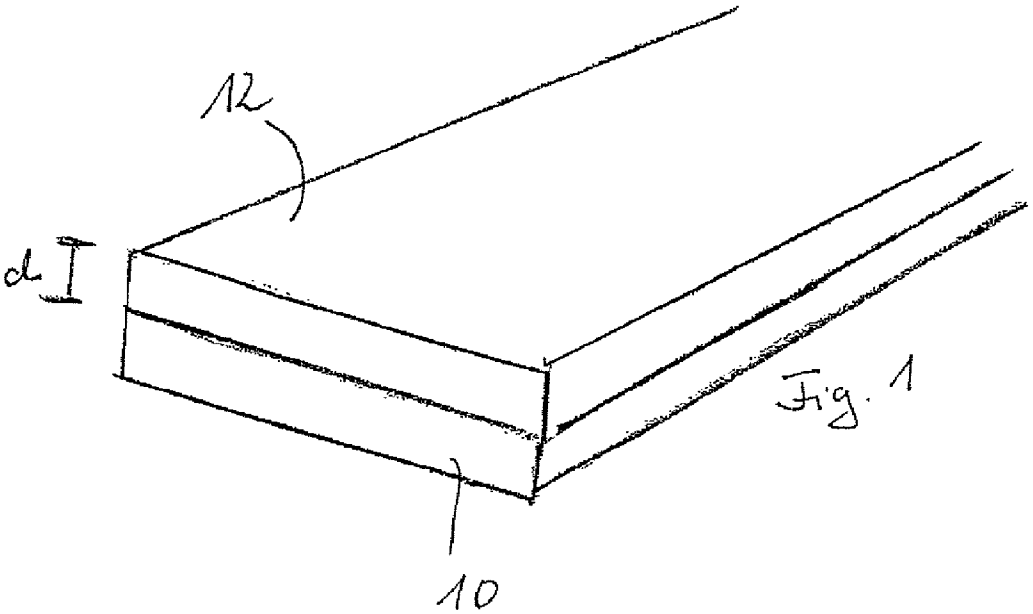
FIG. 1 shows a perspective view of a support module with a light module provided thereon.

When this invention may be embodied in many different forms, there are described in detail herein a specific preferred embodiment of the invention. This description is an exemplification of the principles of the invention and is not intended to limit the invention to the particular embodiment illustrated FIG. 1 shows a support module 10, which has the form of a cube and is realised as a longitudinal stripe. The support module consists of a plastic material, and for instance it can be glued together or screwed together with the floor of the passenger cabin. In this, it is not absolutely necessary that the support module has a rectilinear course, the support module or even the entire escape route marking, respectively, can also have a curved course.

The light module 12 is made up of a transparent plastic material (the binder) into which micro-encapsulated photo-luminescent pigments are incorporated. Strontium aluminates are used as the photo-luminescent particles. The pigments also contain dysprosium oxide and europium oxide.

The light module 2 is made up of a transparent plastic material (the binder), into which micro-encapsulated photo-luminescent pigments are incorporated. Strontium aluminates are used as the photo-luminescent particles. The pigments may also contain dysprosium oxide and europium oxide.

The pigments are completely micro-encapsulated in a plastic material. In this it may be dealt with a polyethylene, which had been further polymerised with anhydrides in order to achieve a complete micro-encapsulation of the pigments.

Figure 2:
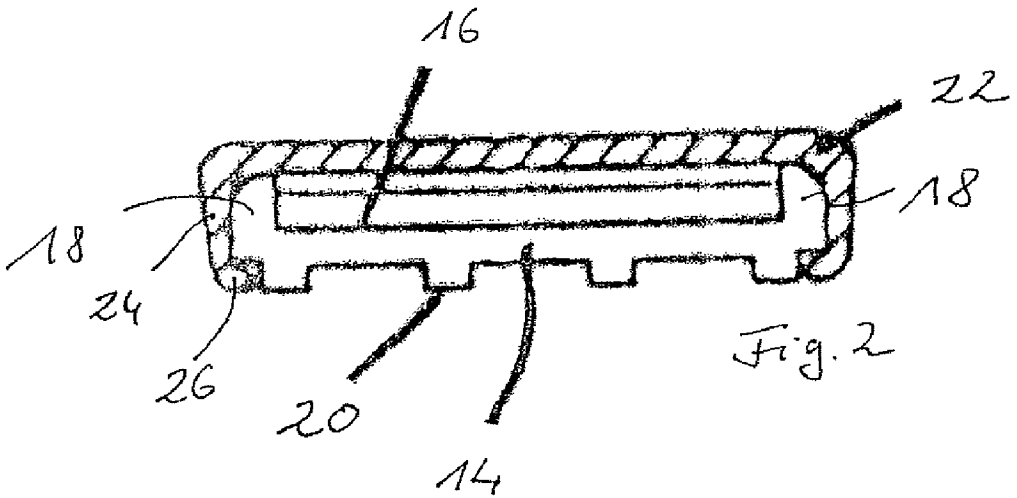
FIG. 2 shows a cross section through a support module with a light module on the inner side, which is additionally protected by a covering.

FIG. 2 shows in a cross section an alternative assembly of an escape route marking, in which a light module 16 is arranged in a support module 14. In its cross section, the support module 14 has lateral periphery walls 18, which form a trough-shaped accommodation space for the light module 16. Projections 20 are provided below the light module 14, which extend in the longitudinal direction of the support module and which serve for a better glueing to the flooring. The support module is covered by a U-shaped covering rail 22, which consists of a transparent material and forms a step protection for the light module 16. The support rail 22 has side walls 24 with a nose 26 projecting on each end thereof, each nose grasping behind a projection on the side walls 18.

Figure 3:
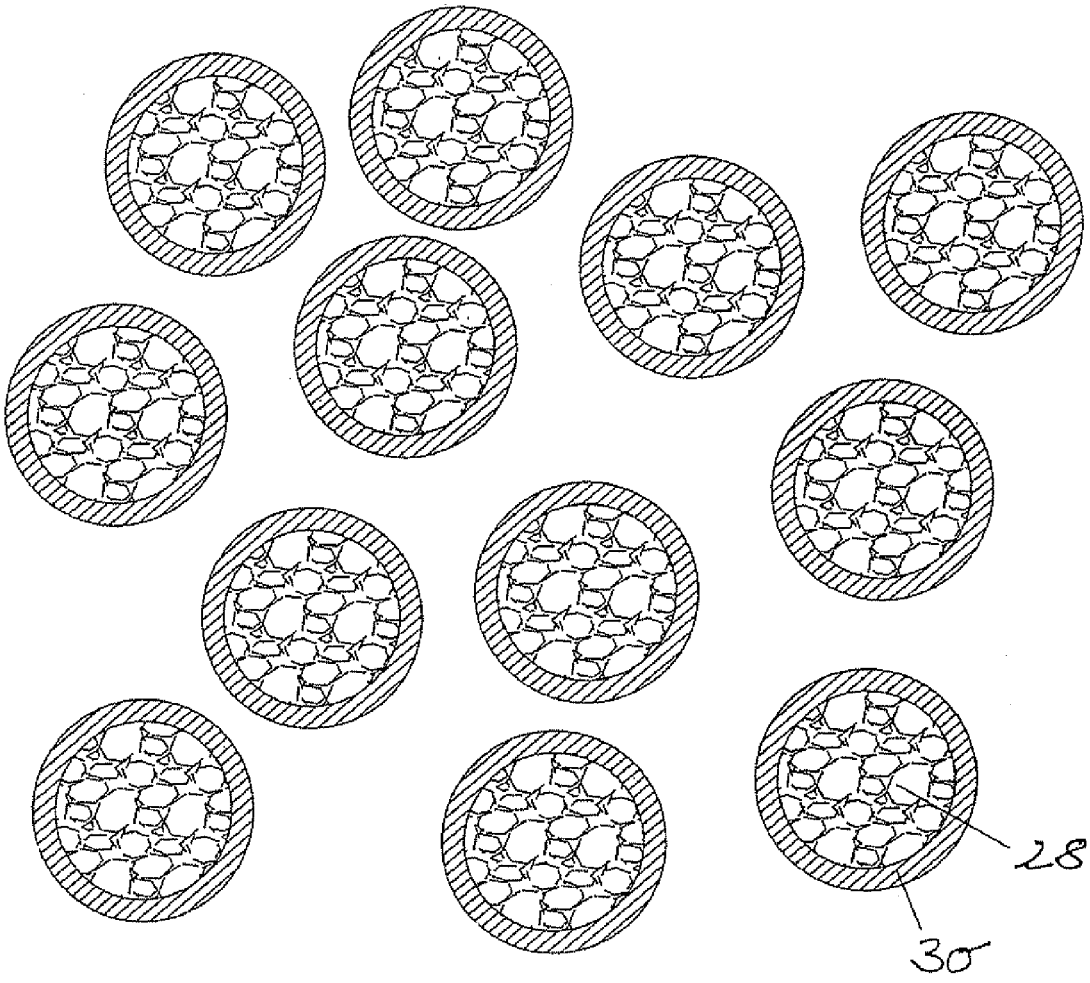
FIG. 3 shows a magnified view of micro-encapsulated pigments.

FIG. 3 shows a detail view of micro-encapsulated pigments 28, which are completely encapsulated by a second material 30. The second material 30 is transparent in order to permit the exit of the light of the pigments. Inside a shell 30, a plurality of the pigments is combined in a cluster. The individual micro-encapsulated pigments are maintained in a matrix of the plastic material.

The invention claimed is:

1. An escape route marking for a passenger cabin in an aeroplane, with a plurality of longitudinal segments which are sequentially arranged along the escape route that is to be marked, wherein each segment has a support module (10; 14) and a light module (12; 16) that is arranged on the support module (10; 14), and the light module (12; 16) has an essentially transparent plastic material into which photo-luminescent pigments are mixed which afterglow in the dark, characterized in that the pigments are micro-encapsulated in a second material being different from the transparent plastic material, such that liquid and moisture do not come into contact with the pigments.

2. An escape route marking according to claim 1, wherein the second material is a plastic material.

3. An escape route marking according to claim 1, wherein the second material features glass or silicate.

4. An escape route marking according to claim 1, wherein the transparent plastic material has a thickness (d) of 0.1 mm to 2.0 mm.

5. An escape route marking according to claim 4, wherein the transparent plastic material has a thickness (d) of 0.2 mm to 1.5 mm.

6. An escape route marking according to claim 1, wherein the transparent plastic material is extruded together with the pigments.

7. An escape route marking according to claim 1, wherein the transparent plastic material with the pigments is printed onto the support module, preferably by screen printing.

8. An escape route marking according to claim 1, wherein the transparent plastic material is cast so as to form a light module.

9. An escape route marking according to claim 1, wherein the transparent plastic material with the pigments is sprayed onto the support module.

10. An escape route marking according to claim 1, wherein the pigments feature strontium aluminate.

11. An escape route marking according to claim 10, wherein the photo-luminescent pigments feature dysprosium oxide and/or europium oxide in addition.

12. An escape route marking according to claim 1, wherein the light module has a curved course.

13. An escape route marking according to claim 1, wherein the light module has a rectilinear course.

* * * * *